United States Patent [19]

Kopsho, Jr. et al.

[11] Patent Number: 4,490,710

[45] Date of Patent: Dec. 25, 1984

[54] CONTROL STICK ASSEMBLY

[75] Inventors: Joseph D. Kopsho, Jr., San Marcos; Edward D. Suszynski, Vista; Reginald S. Johnson, Cardiff-By-The-Sea, all of Calif.

[73] Assignee: Kraft Systems, Inc., Vista, Calif.

[21] Appl. No.: 439,360

[22] Filed: Nov. 5, 1982

[51] Int. Cl.[3] ..... H01C 10/16; G05G 9/04

[52] U.S. Cl. ..... 338/128; 74/471 XY; 74/526; 200/6 A; 200/153 K; 267/150

[58] Field of Search ..... 74/471 XY, 491, 526; 200/6 A, 153 K; 267/150; 338/128

[56] References Cited

U.S. PATENT DOCUMENTS

| | | | |
|---|---|---|---|
| 2,470,968 | 5/1949 | Aske | 201/48 |
| 2,929,258 | 3/1960 | Mackway | 74/471 |
| 3,103,127 | 9/1963 | Hartop | 74/471 |
| 3,277,248 | 10/1966 | Melvin, Jr. | 200/6 |
| 3,308,675 | 3/1967 | Jonsson | 74/471 |
| 3,376,575 | 4/1968 | Peters | 343/225 |
| 3,870,161 | 3/1975 | Cording | 74/471 XY X |
| 3,939,451 | 2/1976 | Kasahima | 338/128 |
| 4,042,902 | 8/1977 | Meyer et al. | 338/128 |
| 4,093,953 | 6/1978 | Hammons et al. | 74/471 XY X |
| 4,101,863 | 7/1978 | Lewicki | 74/471 XY X |
| 4,273,972 | 6/1981 | Butterworth | 200/6 A |
| 4,275,611 | 6/1981 | Asher | 74/471 XY X |
| 4,325,050 | 4/1982 | Suszynski | 338/128 |
| 4,367,373 | 1/1983 | McDaniel et al. | 74/471 XY X |
| 4,375,631 | 3/1983 | Goldberg | 338/128 |

*Primary Examiner*—Allan D. Herrmann

*Attorney, Agent, or Firm*:—Christie, Parker & Hale

[57] ABSTRACT

A control stick assembly capable of conversion between an automatic return mode and a free-floating mode is disclosed. The control stick assembly comprises a control stick, a pair of potentiometers, linkages coupling the control stick to the potentiometers, spring means for urging the control stick toward a select position and means for reversibly disengaging the spring means.

32 Claims, 7 Drawing Figures

CONTROL STICK ASSEMBLY

FIELD OF THE INVENTION

This invention relates to a control stick assembly for generating electrical signals representative of the coordinates of control stick displacement and more particularly to a control stick assembly capable of operation in both an automatic return mode and a free-floating mode.

BACKGROUND OF THE INVENTION

Control stick assemblies are used to generate electrical input signals for model aircraft radio control, computer display courser control, wheel chair controls, etc. There are basically two different types of control stick assemblies, each having a distinct mode of operation. In one type, a spring actuated mechanism is incorporated in the assembly which tends to return the control stick to some neutral or select position automatically when the stick is not acted upon by an external force. In the other type, the spring return mechanism is omitted so that the stick remains wherever placed after the external force is removed.

For some applications one type of device may be preferred over the other type. However, in many applications, an automatic return control stick would be preferred at times and a free-floating control stick would be preferred at other times. For example, the mode of operation for control stick assemblies which are used as an input control device for computer programs generally depend on the software that is used, wherein some software requires an automatic return mode and other software requires a free-floating mode.

SUMMARY

According to the invention, there is provided a control stick assembly capable of conversion between an automatic return mode and a free-floating mode. The control stick assembly comprises a control stick and means for generating an electric signal representative of the control stick position.

The assembly comprises spring means for urging the control stick toward a select or neutral position and means for reversibly disengaging the spring means for preventing the spring means from urging the control stick toward the select position.

In a preferred embodiment of the invention, the means for generating an electric signal representative of the control stick position comprises a potentiometer and a linkage connecting the control stick to the input shaft of the potentiometer so that angular displacement of the control stick about the axis of the input shaft results in rotation of the input shaft. The spring means comprises a movable member which is displaced from a first position toward a second position when the control stick is moved from the select position. The means for reversibly disengaging the spring means comprises a latch capable of releasably engaging and maintaining the movable member in the second position.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
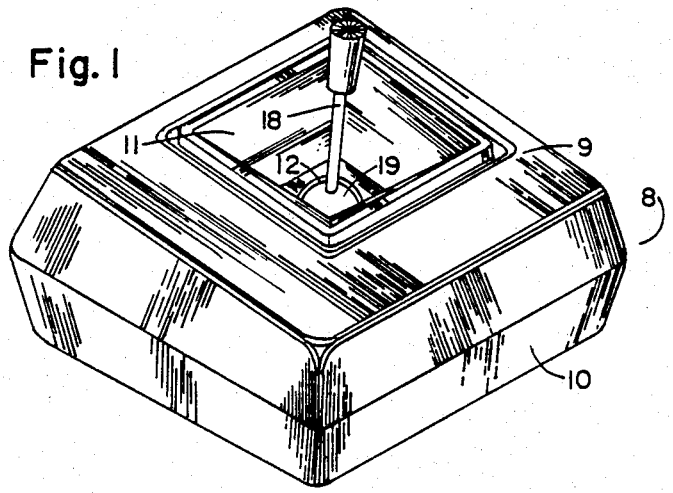
FIG. 1 is a perspective view of a preferred control stick assembly.

A preferred control stick assembly constructed according to principles of the invention is shown in FIG. 1. The assembly comprises a housing 8 having a top panel 9 and a bottom panel 10. The top panel 9 has a truncated pyramidal recess 11 with a control stick access opening 12 at its apex. A ball 19 is located on the underside of top panel 9 in closely spaced relationship to the edges of the access opening 12 and control stick 18 extends upwardly through opening 12 so as to be accessible from the top of housing 8.

Figure 2:
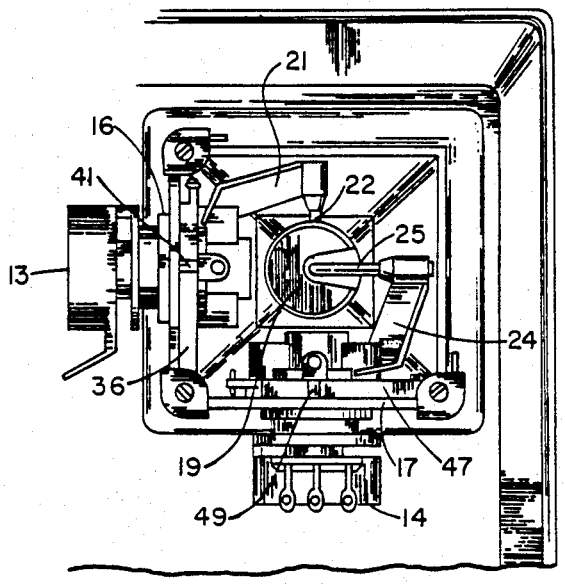
FIG. 2 is a bottom view of the control stick assembly of FIG. 1 with the bottom panel removed.
Figure 3:
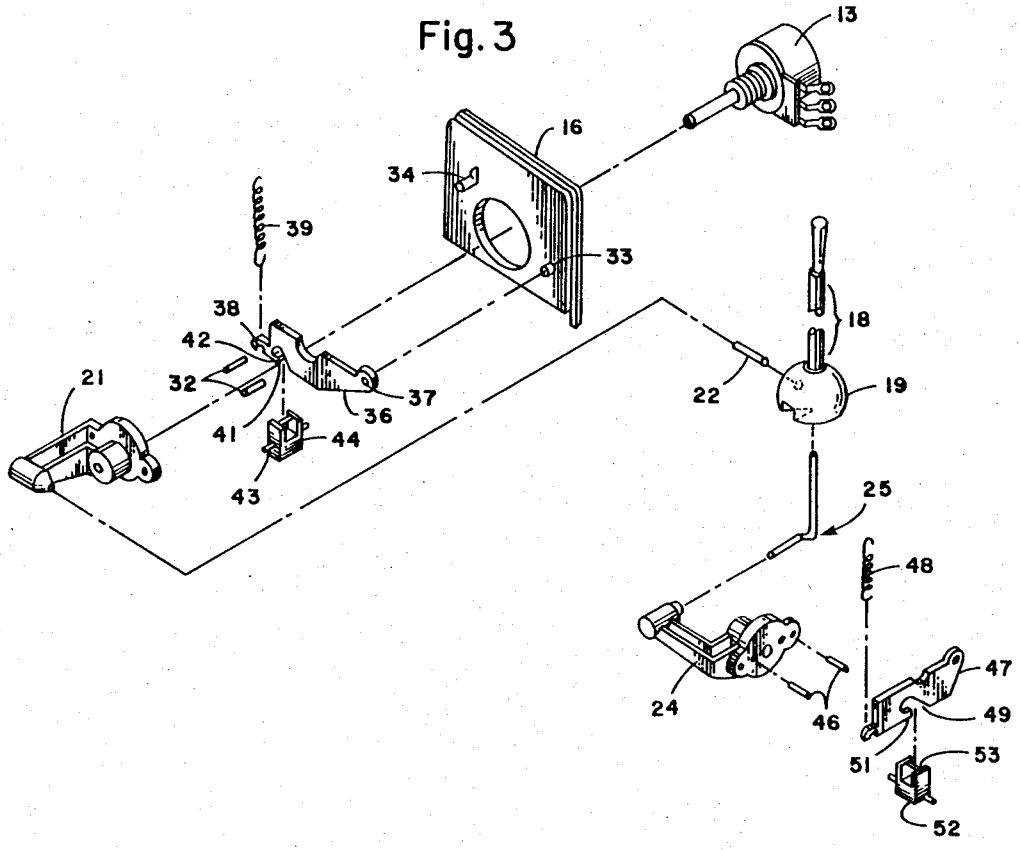
FIG. 3 is an exploded perspective view of the components associated with one axis of the control stick assembly of FIGS. 1 and 2 and part of the other axis thereof.

With reference to FIGS. 2 and 3, first and second potentiometers 13 and 14 are mounted on plates 16 and 17, respectively. One end of a control stick 18 is fixed to the ball 19. Control stick 18 is coupled to the input shaft of the first potentiometer 13 by the first crank 21. Specifically, a first connecting rod 22 extends parallel to the axis of rotation of the input shaft of the second potentiometer 14 from the end of the first crank 21 to ball 19. The first connecting rod 22 is fixed to the ball 19 but is free to rotate and translate with respect to the end of the first crank 21.

Control stick 18 is coupled to the input shaft of the second potentiometer 14 by a second crank 24. A second connecting rod 25 extends parallel to the axis of rotation of the input shaft of the first potentiometer 13 from the end of the second crank 24 to ball 19. The second connecting rod 25 is also fixed to ball 19 but is free to rotate with respect to the second crank 24.

As control stick 18 is displaced so that ball 19 rotates about the axis of the input shaft of potentiometer 13, such rotation is transferred to the input shaft by the first crank 21 and the first connecting rod 22, while the second connecting rod 25 rotates relative to the end of the second crank 24. A battery is connected across the end terminals of potentiometer 13 to produce, between one end terminal and an intermediate terminal, an electrical signal proportional to the rotational displacement of the input shaft.

Likewise, as control stick 18 is displaced so that ball 19 rotates about the axis of the input shaft of potentiometer 14, such rotation is transferred to the input shaft by the second crank 24 and the second connecting rod 25 while the first connecting rod 22 rotates with respect to the end of the first crank 21. A battery is connected across the end terminals of potentiometer 14 to produce, between one end terminal and an intermediate terminal, an electrical signal proportional to the rotational displacement of that input shaft.

Complex displacement of control stick 18 is resolved into components along axes coinciding with the axis of rotation of the input shafts of potentiometers 13 and 14, respectively and electrical signals proportional to the components of this displacement are generated across the terminals of the potentiometers.

The first crank 21 has a flat face from which a pair of pins 32 extends toward a plate 16. The pins 32 are preferably pressed into holes in the flat face of the first crank 21. The location of the pins determines the neutral position of the control stick for one axis. The surface of plate 16 facing toward the first crank 21 has a pair of pegs 33 and 34. A first rocker arm 36 is positioned between the plate 16 and the first crank 21. The first rocker arm 36 has an opening 37 at one end into which peg 33 fits to permit first rocker arm 36 to pivot away from the input shaft of the potentiometer 13. At the other end, the first rocker arm 36 has a hook 38. A spring 39 extends between the hook 38 and the peg 34 to bias the top edge of first rocker arm 36 against both of the pins 32. The spring 39 and the first rocker arm 36, acting through pins 32, provide a return force acting against the control stick 18, when it is displaced in either direction about the axis of the input shaft of potentiometer 13.

More particularly, when the first crank 21 is rotated in one direction due to the displacement of control stick 18, one of the pins 32 causes first rocker arm 36 to pivot from a position adjacent the input shaft of potentiometer 13 to a position removed from the input shaft in which the spring 39 is expanded. When the first crank 21 is rotated in the other direction, the other pin 32 pivots first rocker arm 36 from the position adjacent the input shaft of potentiometer 13 to a position away from the input shaft in which spring 39 is again expanded. Expansion of the spring generates a force acting in a direction opposite the force causing such expansion, i.e., the force causing the displacement of the control stick 18.

Figure 4:
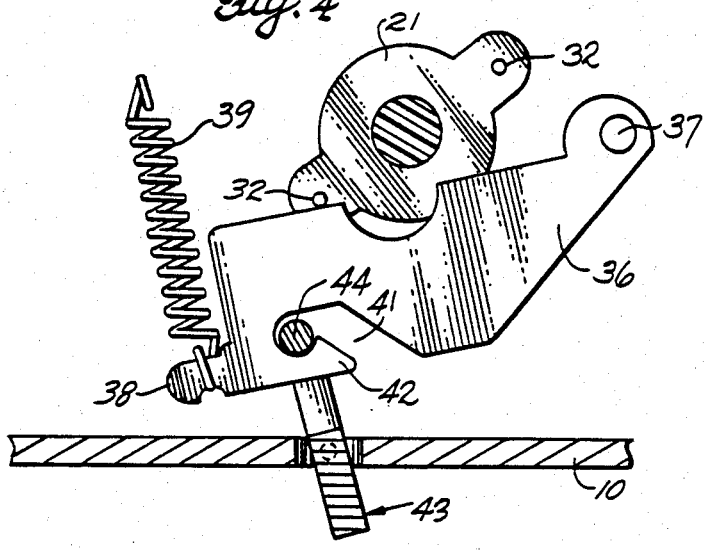
FIG. 4 is a side sectional view of the control stick assembly shown in FIGS. 1 and 3 in a free-floating mode.

With reference to FIGS. 3 and 4, the first rocker arm 36 has a notch 41 extending first generally upwardly from its bottom edge and then generally horizontally sufficiently to form a lip 42. A latch 43 having a bar 44 is mounted on the bottom panel 10 of the housing 8 by pins 45 and afforded pivoting movement between a locked position in which the bar 44 can engage lip 42 when the first rocker arm 36 is displaced from the input shaft of potentiometer 13 and an unlocked position in which bar 44 cannot engage lip 43.

To engage bar 44, latch 43 is first pivoted to the unlocked position. The control stick 18 is displaced so that first rocker arm 36 moves downwardly away from the input shaft of potentiometer 13 as far as possible in order that bar 44 can be positioned in notch 41. Latch 43 is then pivoted to the locked position wherein bar 44 engages lip 42 thereby preventing upward movement of the first rocker arm 36 due to the return force generated by the spring 39. This prevents the return force from acting on the control stick 18 through the first rocker arm 36 and the first crank 21. If an automatic return mode is desired, latch 43 is pivoted to the unlocked position, disengaging bar 44 from lip 42 and allowing first rocker arm 36 to respond to the force generated by spring 39 and 15 to act on the control stick 18 through the first crank 21. Thus, latch 43 acts with rocker arm 36 as a switch to render control stick 58 free of spring force when bar 44 lies in notch 41 and to apply spring force to control stick 58 when latch 43 is pivoted to free bar 44. from notch 41.

The elements associated with potentiometer 14 are the same as those described in connection with potentiometer 13. That is, the second crank 24 has a flat face from which a pair of pins 46 extend toward a plate 17. A second rocker arm 47 is pivotally mounted between the second crank 24 and plate 17. A spring 48 generates a return force against second rocker arm 47 when it is displaced against the force of spring by pins 46 when second crank 24 is rotated.

The second rocker arm 47 has a notch 49 and lip 51 similar to notch 41 and lip 42 of first rocker arm 36. A second latch 52 having a bar 53 is pivotally mounted on the bottom panel of the housing 10 for removably engaging the lip 42 when the second rocker arm 47 has been displaced and the spring 48 has been expanded. When the bar 53 engages the lip 51, the second rocker arm 47 is prevented from responding to the force generated by spring 48 and therefore preventing the return force generated by spring 48 from acting upon control stick 18.

The present invention is equally applicable to other control stick assembly designs which incorporate a spring mechanism for automatically returning the control stick to a select position.

Figure 5:
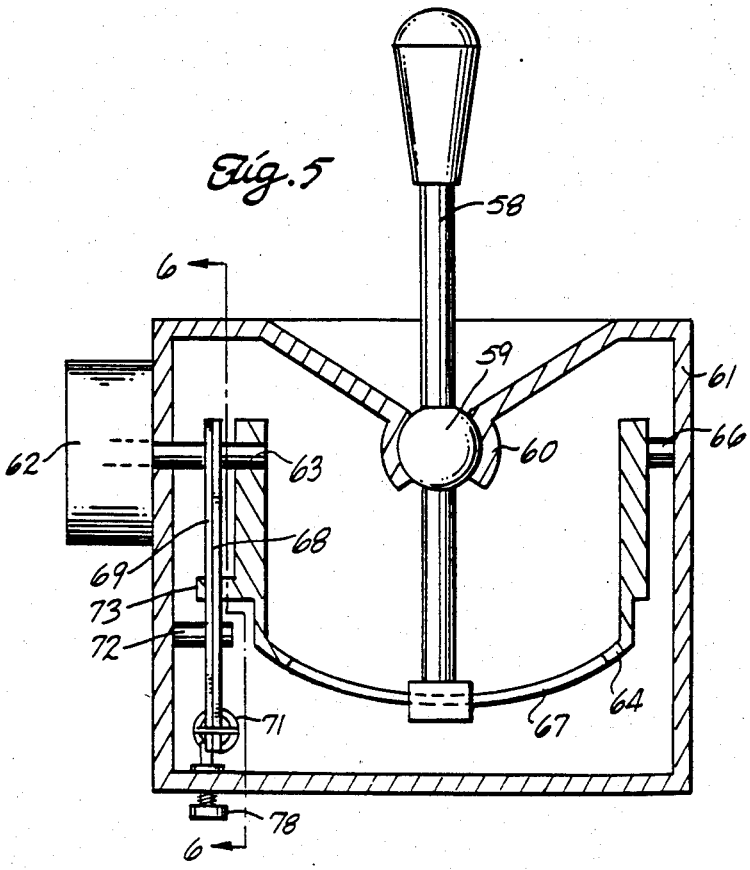
FIG. 5 is a front sectional view of another preferred control stick assembly.

For example, FIG. 5 shows another preferred control stick assembly constructed in acordance with the invention. The assembly comprises a control stick 58 having ball 59 rotatably mounted in a corresponding socket in a housing 61 thereby permitting control stick 60 to pivot relative to housing 22. A first potentiometer 62 is mounted on the outside of the housing 61. A rotatable input shaft 63 of the potentiometer 61 extends into the interior of the housing 61. One end of a pivotable, U-shaped linkage 63 is rigidly attached to the input shaft 63. The other end of the linkage 64 is rotatably attached to the housing 61 by a pivot pin 66. The lower end of the control stick 58 is slidably captured in a slot 67 in the linkage 64. When the control stick 58 is displaced, input shaft 63, which is coupled by linkage 64 to ball 59, rotates an amount proportional to the displacement of the control stick 58.

Lever arms 68 and 69 are mounted on input shaft 63 so that they are free to rotate relative thereto. A spring 71 interconnects the lever arms 68 and 69 to urge them together. A peg 72 is disposed between the lever arms 68 and 69. The end of the linkage 64 that is attached to the input shaft 63 has a stop pin 73, also positioned between lever arms 68 and 69.

When the control stick 58 is displaced from its neutral position, the stop pin 73 causes the lever arm 68 (or lever arm 69) to rotate away from the peg 72. The force generated by the spring 71 urges lever arm 68 (or lever arm 69) back towards the peg 72. Thus, when control stick 58 is released, it returns to the neutral position.

A second potentiometer, similar to the first potentiometer, is also mounted on the outside of the housing and has an input shaft extending into the interior of the housing. The input shaft to the second potentiometer is generally perpendicular to the input shaft 63 of the first potentiometer 62 and is connected to the control stick 68 in a manner similar to that described for input shaft 63, i.e., by a second linkage similar in construction to the first linkage 64. A pair of lever arms rotatably mounted on the input shaft and interconnected by a spring provide a return force against the control stick 58 when it is displaced such that ball 59 rotates about the axis of the input shaft of the second potentiometer.

Figure 6:
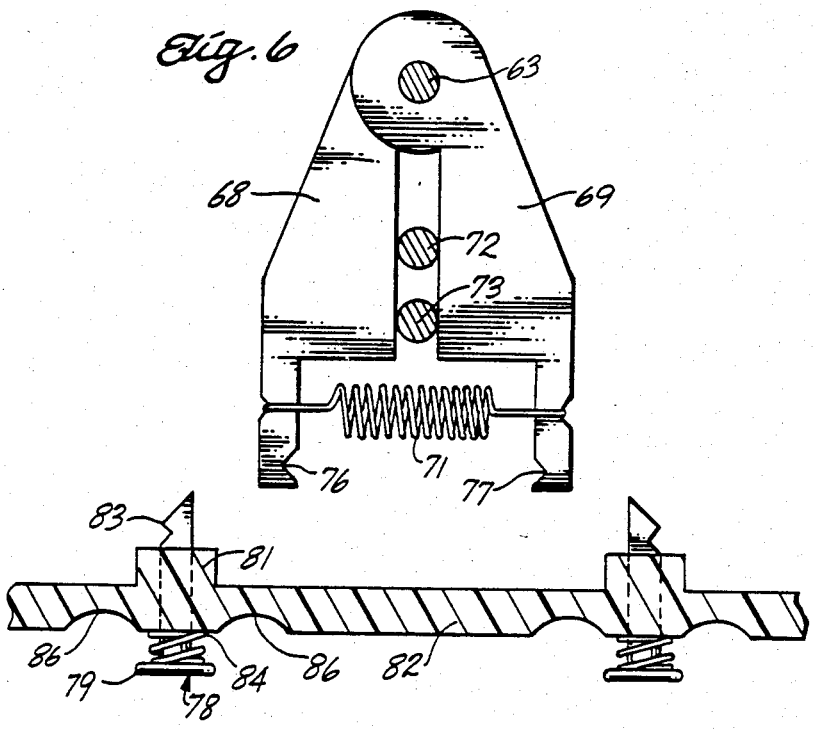
FIG. 6 is a side sectional view of the control stick assembly shown in FIG. 5 in an automatic return mode.
Figure 7:
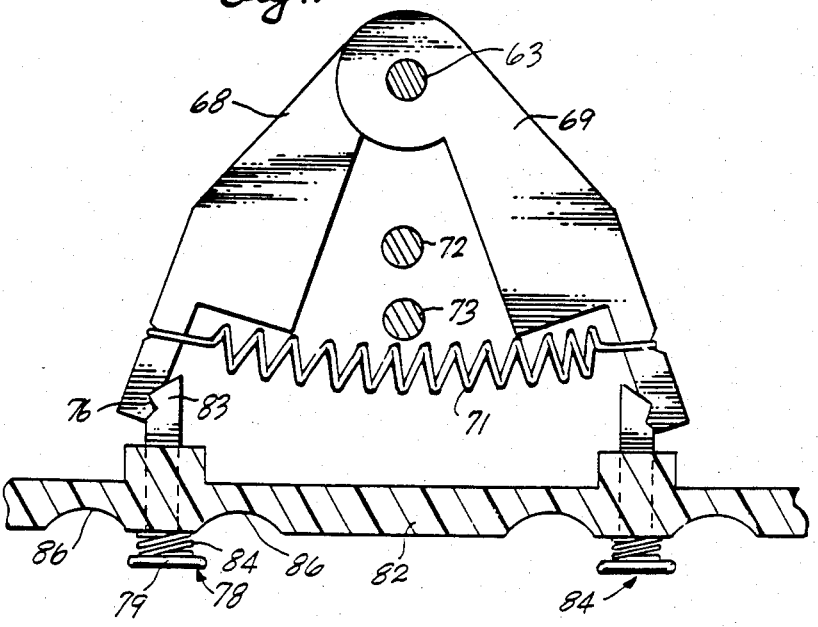
FIG. 7 is a side sectional view of the control stick assembly shown in FIG. 5 in a free-floating mode.

With reference to FIGS. 6 and 7, the lever arm 68 has a notch 76 which faces a corresponding notch 77 on lever arm 69. A latch pin 78 having a head 79 and a shaft 81 is mounted on the bottom panel 82 of the housing. The shaft 81 extends through the bottom panel 82 into the interior of the housing. The end of the shaft 81 remote from the head 79 has a tang 83. A spring 84 is disposed around the shaft between the exterior surface of the bottom panel of the housing and the head 79 of the latch pin 78.

The latch pin 78 is mounted on the bottom panel 82 at a position in which the notch 76 in lever arm 68 is directly above the tang 83 of latch pin 78 when the lever arm 68 is rotated away from peg 72 as far as possible as a result of the displacement of control stick 58.

A second latch pin 84 is similarly associated with lever arm 69. Third and fourth latch pins are likewise associated with the lever arms rotatably mounted on input shaft of the second potentiometer.

With reference to FIG. 7, the control stick assembly is converted from an automatic return mode to a free-floating mode by displacing the control stick 58 so that lever arm 68 rotates away from peg 72. Latch pin 78 is moved upwardly against the force of spring 84 until the tang 83 engages the notch 76, thereby preventing the lever arm from responding to the return force generated by spring 71 as a result of its expansion. This prevents the return force from acting on control stick 58. This procedure is repeated for lever arm 69 and both lever arms associated with the second potentiometer.

To convert from a free-floating mode to an automatic return mode, the tang 83 is disengaged from notch 76 by manually pulling the head 79 of the latch pin 78 downwardly. A pair of indentations 86 in the bottom panel 82 are provided to facilitate gripping of the head 79. The spring 84 assures that when the latch pin 78 is not engaged with the lever arm 68, the latch pin 78 will be sufficiently below the lever arm 68 to not interfere with the movement of the lever arm. Each latch pin can be so disengaged from its associated lever arm.

The preceding description has been presented with reference to the presently preferred embodiments of the invention shown in the accompanying drawings. Workers skilled in the art and technology to which this invention pertains will appreciate that alterations and changes in the described devices can be practiced without meaningfully departing from the principles, spirit and scope of this invention. For example, the means for generating an electrical signal representative of control stick position has been described in terms of potentiometers and mechanical linkages which couple the control stick with the potentiometers. This invention is equally applicable to other means for generating an electrical signal representative of control stick position. Magnetic couplings as well as couplings utilizing the Hall effect are known for generating electrical signals representative of control stick position.

Accordingly, the foregoing description should not be read as pertaining only to the precise devices described, but rather should be read consistent with and as support for the following claims which are to have their fullest fair scope.

What is claimed is:

1. A control stick assembly comprising:

a movable control stick;

means for generating an electric signal representative of control stick position;

spring means for urging the control stick toward a select position; and means for reversibly disengaging the spring means to thereby prevent said spring means from urging the control stick toward the select position without restricting movement of the control stick.

2. A control stick assembly as claimed in claim 1 wherein the spring means comprises:

a movable member which is displaced from a first position toward a second position when the control stick is displaced from the select position; and a spring which generates a return force against the movable member when it is displaced toward the second position.

3. A control stick assembly as claimed in claim 2 wherein the means for reversibly disengaging said spring means comprises a latch for releasably engaging the movable member and maintaining the movable member in about the second position.

4. A control stick assembly comprising:

a potentiometer having a rotatable input shaft;

a control stick;

a linkage connecting the control stick to the input shaft for rotating the input shaft in response to displacement of the control stick;

a movable member which is displaced from a first position toward a second position when the control stick is displaced from a select position;

a spring which is expanded when the movable member is displaced toward the second position; and means for releasably maintaining expansion of the spring.

5. A control stick assembly as claimed in claim 4 wherein the means for releasably maintaining expansion of the spring comprises a latch for releasably engaging and maintaining the movable member in the second position.

6. A control stick assembly comprising:

a potentiometer having a rotatable input shaft;

a control stick;

a linkage connecting the control stick to the input shaft for rotating the input shaft in response to displacement of the control stick;

a movable member, which is displaced from a first position toward a second position when the control stick is displaced from a select position;

a spring which generates a return force against the movable member when it is displaced toward the second position; and a latch for releasably engaging the movable member and maintaining the movable member in about the second position.

7. A control stick assembly comprising:

a first potentiometer having a first rotatable input shaft;

a second potentiometer having a second rotatable input shaft;

a control stick;

a first linkage connecting the control stick to the first input shaft for rotating the first input shaft in response to displacement of the control stick from a first neutral position along a first axis;

a second linkage connecting the control stick to the second input shaft for rotating the second input shaft in response to displacement of the control stick from a second neutral position along a second axis;

first spring means for urging the control stick toward the first neutral position when the control stick is displaced from the first neutral position along the first axis;

second spring means for urging the control stick toward the second neutral position when the control stick is displaced from the second neutral position along the second axis;

means for reversibly disengaging said first spring means; and means for reversibly disengaging said second spring means.

8. A control stick assembly as claimed in claim 7 wherein the first spring means comprises:

a first movable member which is displaced toward a first displaced position when the control stick is displaced from the first neutral position along the first axis; and a first spring which generates a return force against the first movable member when it is displaced toward the first displaced position.

9. A control stick assembly as claimed in claim 8 wherein the means for reversibly disengaging said first spring means comprises a first latch for releasably locking the first movable member in about the first displaced position.

10. A control stick assembly as claimed in claim 7 wherein the second spring means comprises:

a second movable member which is displaced toward a second displaced position when the control stick is displaced from the second neutral position along the second axis; and a second spring which generates a return force against the second movable member when it is displaced toward the second displaced position.

11. A control stick assembly as claimed in claim 10 wherein the means for reversibly disengaging said second spring means comprises a second latch for releasably locking the second movable member in about the second displaced position.

12. A control stick assembly comprising:

a first potentiometer having a first rotatable input shaft;

a second potentiometer having a second rotatable input shaft;

a control stick;

a first crank connecting the control stick to the first input shaft for rotating the first input shaft in response to angular displacement of the control stick about the axis of the first input shaft;

a second crank connecting the control stick to the second input shaft for rotating the second input shaft in response to angular displacement of the control stick about the axis of the second input shaft;

a first rocker arm capable of pivoting movement between a first select position and a first displaced position, which is displaced from the first select position toward the first displaced position when the control stick is displaced from a first neutral position in either direction about the axis of the first input shaft;

a second rocker arm capable of pivoting movement between a second select position and a second displaced position which is displaced from the second select position toward the second displaced position when the control stick is displaced from a second neutral position in either direction about the axis of the second input shaft;

first spring means for urging the first rocker arm toward the first select position;

second spring means for urging the second rocker arm toward the second select position;

means for releasably locking the first rocker arm in the first displaced position; and means for releasably locking the second rocker arm in the second displaced position.

13. A control stick assembly as claimed in claim 12 wherein the first rocker arm comprises a first notch and the means for releasably locking the first rocker arm in the first displaced position comprises a first latch, which is pivotally mounted for releasably engaging the first notch when the first rocker arm is in the first displaced position to thereby secure and maintain the first rocker arm in the first displaced position.

14. A control stick assembly as claimed in claim 12 wherein the second rocker arm comprises a second notch and the means for releasably locking the second rocker arm in the second displaced position comprises a second latch, which is pivotally mounted for releasably engaging the second notch when the second rocker arm is in the second displaced position to secure and maintain the second rocker arm in the second displaced position.

15. A control stick assembly comprising:

a potentiometer having a rotatable input shaft;

a control stick;

a linkage connecting the control stick to the input shaft for rotating the input shaft in response to angular displacement of the control stick about the axis of the input shaft;

first and second movable lever arms wherein the first lever arm is displaced away from the second lever arm when the control stick is displaced from a select position in one direction about the axis of the input shaft and wherein the second lever arm is displaced away from the first lever arm when the control stick is displaced from the select position in the other direction about the axis of the input shaft;

a spring for urging the first and second lever arms together;

a first latch pin for releasably engaging and maintaining the first lever arm at a first displaced position, away from the second lever arm, and preventing the spring from urging the first lever arm toward the second lever arm;

a second latch pin for releasably engaging and maintaining the second lever arm at a second displaced position, away from the first lever arm, and preventing the spring from urging the second lever arm toward the first lever arm.

16. A control stick assembly as claimed in claim 15 wherein the first lever arm comprises a first notch and the first latch pin comprises a first tang for releasably engaging the first notch when the first lever arm is in the first displaced position.

17. A control stick assembly as claimed in claim 16 wherein the second lever arm comprises a second notch and the second latch pin comprises a second tang for releasably engaging the second notch when the second lever arm is in the second displaced position.

18. The control stick assembly as claimed in claim 15 further comprising a housing for enclosing the potentiometer, the linkage, the movable lever arms and the spring and wherein the first and second latch pins extend through the housing to thereby enable manipulation of the first and second latch pins at a position exterior of the housing.

19. A control stick asembly as claimed in claim 15 further comprising:

a second potentiometer having a second rotatable input shaft;

a second linkage connecting the control stick to the second input shaft for rotating the second input shaft in response to angular displacement of the control stick about the axis of the second input shaft;

third and fourth movable lever arms wherein the third lever arm is displaced away from the fourth lever arm when the control stick is displaced from a select position in one direction about the axis of the second input shaft and wherein the fourth lever arm is displaced away from the third lever arm when the control stick is displaced from the select position in the other direction about the axis of the second input shaft;

a second spring for urging the third and fourth lever arms together;

a third latch pin for releasably engaging and maintaining the third lever arm at a third displaced position, away from the fourth lever arm, and preventing the second spring from urging the third lever arm toward the fourth lever arm; and a fourth latch pin for releasably engaging and maintaining the fourth lever arm at a fourth displaced position, away from the third lever arm, and preventing the second spring from urging the fourth lever arm toward the third lever arm.

20. A control stick assembly as claimed in claim 19 wherein the third lever arm comprises a third notch and the third latch pin comprises a third tang for releasably engaging the third notch when the third lever arm is in the third displaced position.

21. A control stick assembly as claim in claim 20 wherein the fourth lever arm comprises a fourth notch and the fourth latch pin comprises a fourth tang for releasably engaging the fourth notch when the fourth lever arm is in the fourth displaced position.

22. A control stick assembly as claimed in claim 19 further comprising a housing for enclosing the potentiometers, the linkages, the movable lever arms and the springs and wherein each latch pin extends through the housing and can be manipulated at a position exterior of the housing.

23. A control stick assembly comprising:

a housing;

a potentiometer within the housing having a rotatable input shaft;

a control stick protruding from the housing;

a linkage connecting the control stick to the input shaft for rotating the input shaft in response to angular displacement of the control stick about a first axis;

first and second movable lever arms wherein the first lever arm is displaced away from a select position when the control stick is displaced from a center position in one direction about the first axis and wherein the second lever arm is displaced away from the select position when the control stick is displaced from the center position in the other direction about the first axis;

spring means for urging the first and second lever arms toward the select position to thereby bias the control stick toward the center position when the control stick is displaced from the center position in either direction about the first axis; and means for reversibly disengaging the spring means to thereby prevent said spring means from urging the first and second lever arms toward the select position.

24. A control stick assembly as claimed in claim 23 wherein the means for reversibly disengaging the spring means can be manually operated at a position exterior of the housing.

25. A control stick assembly as claimed in claim 23 further comprising:

a second potentiometer within the housing having a second rotatable input shaft;

a second linkage within the housing connecting the control stick to the second input shaft for rotating the second input shaft in response to angular displacement of the control stick about a second axis;

third and fourth movable lever arms wherein the third lever arm is displaced away from a second select position when the control stick is displaced from the center position in one direction about the second axis and wherein the fourth lever arm is displaced away from the second select position when the control stick is displaced from the center position in the other direction about the second axis;

second spring means for urging the third and fourth lever arms toward the second select position to thereby bias the control stick toward the center position when the control stick is displaced from the center position in either direction about the second axis; and second means for reversibly disengaging the second spring means to thereby prevent said second spring means from urging the third and fourth lever arms toward the second select position.

26. A control stick assembly as claimed in claim 25 wherein the second means for reversibly disengaging the second spring means can be manually operated at a position outside of the housing.

27. A control stick assembly comprising:

a movable control stick;

means for generating an electrical signal representative of control stick position;

an automatic return mode wherein the control stick is movable and is biased toward a select position when the control stick is displaced from that select position;

a free floating mode wherein the control stick is movable and is not biased toward the select position when the control stick is displaced from the select position; and means for switching between the automatic return mode and the free floating mode.

28. A control stick assembly comprising:

a potentiometer having a rotatable input shaft;

a control stick;

a linkage connecting the control stick to the input shaft for rotating the input shaft in response to angular displacement of the control stick about a first axis;

first and second lever arms rotatable about a common axis;

a stop pin and a stationary peg lying between the lever arms in the path of rotation thereof, the peg defining a center position for the control stick about the first axis;

means for connecting the pin to the control stick to be displaced about the first axis therewith;

a spring connected between the first and second lever arms to urge them toward the pin and the peg so the pin bears on one lever arm and the peg bears on the other lever arm to exert a return to center force on the control stick when the control stick is displaced from the center position about the first axis; and means for reversibly removing the return to center force on the control stick so the control stick is free floating when the control stick is displaced from the center position about the first axis.

29. A control stick assembly as claimed in claim 28 further comprising:

a second potentiometer having a second rotatable input shaft;

a second linkage connecting the control stick to the second input shaft for rotating the second input shaft in response to angular displacement of the control stick about a second axis;

third and fourth lever arms rotatable about a common axis;

a second stop pin and a second statinary peg laying between the third and fourth lever arms in the path of rotation thereof, the second peg defining a center position for the control stick about the second axis;

means for connecting the second pin to the control stick to be displaced about the second axis therewith;

a second spring connected between the third and fourth lever arms to urge them toward the second pin and the second peg so the second pin bears on one lever arm and the peg bears on the other lever arm to exert a second return to center force on the control stick when the control stick is displaced from the center position about the second axis; and means for reversibly removing the second return to center force on the control stick so the control stick is free floating when the control stick is displaced from the center position about the second axis.

30. A control stick assembly comprising:

a control stick;

means for supporting the control stick for movement between predetermined limits;

means for generating an electric signal representative of control stick position;

spring means for urging the control stick toward a select position when the control stick is displaced from the select position anywhere within the predetermined limits; and means for reversibly disengaging the spring means to thereby prevent said spring means from urging the control stick toward the select position when the control stick is displaced from the select position anywhere within the predetermined limits.

31. A control stick assembly comprising:

a control stick;

means for rotatably supporting the control stick;

means for generating an electric signal representative of control stick position;

a switch movable between a first position and a second position;

a source of spring force; and means in the first position of the switch for applying the spring force to the control stick to urge the control stick toward a select position, the control stick being free of the influence of the source of spring force when the switch is in the second position.

32. A control stick assembly as claimed in claim 31 additionally comprising a housing for enclosing the generating means, the source and the applying means so one end of the switch protrudes from the housing and the remainder of the switch is enclosed by the housing.

* * * * *